US009777415B2

(12) United States Patent
Andersen

(10) Patent No.: US 9,777,415 B2
(45) Date of Patent: Oct. 3, 2017

(54) METHOD AND APPARATUS FOR DRY-FORMING A FIBROUS PRODUCT

(71) Applicant: Formfiber Denmark ApS, Galten (DK)

(72) Inventor: Carsten Andersen, Galten (DK)

(73) Assignee: Formfiber Denmark ApS, Galten (DK)

( * ) Notice: Subject to any disclaimer, the term of this patent is extended or adjusted under 35 U.S.C. 154(b) by 0 days.

(21) Appl. No.: 14/787,567

(22) PCT Filed: Apr. 28, 2014

(86) PCT No.: PCT/EP2014/058557

§ 371 (c)(1),
(2) Date: Oct. 28, 2015

(87) PCT Pub. No.: WO2014/177497

PCT Pub. Date: Nov. 6, 2014

(65) Prior Publication Data

US 2016/0076183 A1 Mar. 17, 2016

(30) Foreign Application Priority Data

May 3, 2013 (EP) ..... 13166383

(51) Int. Cl.
*D04H 1/732* (2012.01)
*D01G 25/00* (2006.01)

(52) U.S. Cl.
CPC ..... *D04H 1/732* (2013.01); *D01G 25/00* (2013.01)

(58) Field of Classification Search
None
See application file for complete search history.

(56) References Cited

U.S. PATENT DOCUMENTS

| | | | | |
|---|---|---|---|---|
| 3,748,693 | A | 7/1973 | Jespersen | |
| 8,562,879 | B2 * | 10/2013 | Frost | B32B 5/26 264/113 |
| 2005/0098910 | A1 * | 5/2005 | Andersen | B07B 1/10 264/39 |
| 2010/0283176 | A1 * | 11/2010 | Eriksen | D01G 25/00 264/175 |
| 2011/0247839 | A1 * | 10/2011 | Lalouch | A62C 2/06 169/45 |

FOREIGN PATENT DOCUMENTS

| | | | |
|---|---|---|---|
| EP | 0168957 | A1 | 1/1986 |
| EP | 2078769 | A1 | 7/2009 |
| GB | 2141150 | A | 12/1984 |
| WO | 2005044529 | | 5/2005 |
| WO | 2009048859 | A1 | 4/2009 |
| WO | 2011156300 | A1 | 12/2011 |

* cited by examiner

*Primary Examiner* — Mary F Theisen
(74) *Attorney, Agent, or Firm* — Dinsmore & Shohl LLP

(57) ABSTRACT

The invention regards a forming box for use in dry-forming a mat of fibrous material, said forming box comprising a housing with an open bottom for providing direct access of the fibers onto an underlying forming wire and a vacuum box underneath said forming wire, at least one inlet for supplying fiber material into the inside of the housing, a number of spike rollers are provided in at least one row in the housing between the fiber inlet and the housing bottom, wherein a screen is provided adjacent said spike rollers, said screen comprising a plurality of slats, wherein each slat is rotatable.

19 Claims, 4 Drawing Sheets

METHOD AND APPARATUS FOR DRY-FORMING A FIBROUS PRODUCT

CROSS REFERENCE TO RELATED APPLICATIONS

The application is the U.S. national phase of PCT/EP2014/058557, filed Apr. 28, 2014, which claims priority to European patent application No. 13166383.3, filed May 3, 2013, the contents of which are incorporated herein in their entirety.

FIELD OF INVENTION

The invention relates to a forming box for use in dry-forming a mat of fibrous material, said forming box comprising a housing with an open bottom for providing direct access of the fibres onto an underlying forming wire, and a vacuum box underneath said forming wire; at least one inlet for supplying fibre material into the inside of the housing; a number of spike rollers are provided in at least one row in the housing between the fibre inlet and the housing bottom.

BACKGROUND OF THE INVENTION

From WO 2005/044529, a device of such kind is known. The forming box of the apparatus described therein comprises a conveyer in the form of an endless belt screen adjacent to the row of spike rollers. As fibres enter the forming box they are sucked towards the forming wire and are distributed by the spike rollers, ensuring a relatively even distribution of fibrous material in the dry-formed mat. The conveyer ensures that no large lumps of fibrous material end up at the forming wire.

SUMMARY OF THE INVENTION

Considering the prior art described above, it is an object of the present invention to get a better control over the distribution of the fibrous material over the entire area of the forming wire within the forming box.

The object can be achieved by means of a forming box of the initially mentioned kind, wherein; a screen is provided adjacent said spike rollers, said screen comprising a plurality of slats, wherein each slat is rotatable.

By use of a screen comprising a plurality of slats it is possible to generate turbulence, which slows down the flow of fibres from the inlet to the forming wire and/or direct the fibrous material towards the desired area within the forming box. Here it obtains control over the distribution of the fibrous material in the mat. If the slats are not continuously rotating they can, for example, be positioned at a specific angle, hereby functioning as a fin to direct the fibrous material towards the desired area. Another alternative is to have the slats rotate any number of revolutions or part of a revolution and the change the direction and repeat the procedure. These different options on how to control the slats ensure the desired distribution of material in the mat for all types of fibrous material. Different laying formation of the fibres may, in this way, be achieved for forming fibre mats with a particular desired pattern.

Slat should be understood as a long and relatively thin, compared to its length, piece of material. The words lamella can also be used to denote the slats of the present invention. The slats can be rotated within the forming box along its longitudinal axis.

In an embodiment, the slats extend substantially perpendicular and/or parallel to the direction of the inlet. Hereby, the turbulence generated by the screen can be adapted to compensate for the irregularities in the distribution of the fibrous material when entering through the inlet.

Advantageously, all the slats are rotated in the same or different direction. Depending on the material used in the forming box it may be desired that the slats rotate in the same direction, alternatively, some of the slats may rotate in the opposite direction, a further alternative is that some of the slats do not rotate, but rather are used as fins to direct fibrous material to the desired area of the forming wire. The rotation is preferably continuous; however, a non-continuous rotation of one or more of the slats can be used.

In an embodiment, the slats are pivoted individually. To a greater extent, this provides more control over the distribution of the fibrous material, both when suspended inside the forming box and when it settles on the forming wire.

In an embodiment, the slats are provided with a non-symmetric cross-section. This can be done in order to enhance the turbulence and/or directing the fibrous material in the forming box. Further, the turbulence generated by the slats can ensure that the slats are self-cleaning; so the turbulence will remove fibrous material stuck on the slats.

In an embodiment, the forming box comprises at least two rows of spike rollers and at least two screens adjacent a row of spikes rollers, wherein each screen comprises a plurality of slats, wherein each slat is rotatable. Having more than one set of row spike rollers and screens provide extra disintegration of fibres or lumps of fibres by the spike rollers, which may be advantageous for some applications.

Preferably, the slats are provided with a predetermined mutual distance, said distance being adjustable. Hereby a further enhancement of the control of the distribution of the fibrous material may be achieved.

In an embodiment, a separate material inlet is provided above the fibre inlet, and a granulate material or a second type of fibre material is supplied through said separate material inlet, so this second material supply is mixed with the fibres supplied through the fibre inlet. Hereby a mat comprising different types of fibre material can be produced. It is advisable to transport different types of fibre material at different air speeds, and in order for the fibres to be able to mix, it is advantageous to have a separate inlet for each of the fibrous materials used.

In an embodiment, the rotation and/or pivoting of the slats are controlled by the properties of the mat exiting the forming box; preferably the properties are determined by use of a scanner. Hereby the quality control of the mat made of fibrous material can be made in situ and the slats can be regulated in order to ensure a high quality of the mats.

In an embodiment, the slats are adapted to neutralize a build-up of static electricity on the slats. Static electricity can be a problem during dry-forming of mats, especially in dry environments. In order to neutralize the build-up of static electricity on the slats the slats can be made of a material or coated with a material so that build-up of static electricity is less likely or difficult to occur and/or the slats can be electrically connected to a discharge device and/or ground.

The invention further regards a method for the dry-forming of a mat of fibrous material, comprising the steps of; blowing fibrous material into a forming box, having an open bottom positioned over a forming wire to form a mat of fibres on the forming wire, the forming box having a plurality of fibre-separating spike rollers for breaking apart clumps of fibres; providing a screen of slats adjacent the spike rollers, and conditioning the fibres inside the housing by rotating one or more of the slats.

The conditioning of the fibres is performed by the rotation of the slats, and slows the flow of the fibres from the inlet to the forming wire. The result is a controllable cross-sectional distribution of fibres in the forming box. Hereby different formations of the fibres on the forming wire may be achieved.

Preferably, the conditioning of the fibres includes the step of stirring up the fibres inside the housing. Hereby the fibres are distributed within the forming box. The stirring up of the fibres can be done by generating turbulence in the air flow by rotating the slats.

In an embodiment, the conditioning involves directing the fibres towards the bottom of the forming box. Hereby, the fibrous material, forming the mat, can be distributed in the desired manner.

Advantageously, the one of more of the slats are non-rotating. The slats can then be used to passively direct the fibrous material towards the desired area of the forming wire.

In an embodiment, the non-rotating slats are angled to direct the fibres towards the forming wire.

In an embodiment, a separate material inlet is provided above the fibre inlet, and that a granulate material or a second type of fibre material is supplied through said separate material inlet, so this second material supply is mixed with the fibres supplied through the fibre inlet. Hereby, a mat comprising different types of fibre material can be produced. Preferably, the supplied granulate is selected from a group of materials including: vermiculite, rubber, plastic, glass fibre or mineral wool fibres.

Preferably, the supplied granulate is a metallic granulate or metallic fibre, such as aluminium, brass or steel.

It is to be understood, that the method can be adapted to comprise any of the preferred embodiments mentioned above for the forming box.

DESCRIPTION OF THE DRAWINGS

The invention will in the following be described in greater detail with reference to the accompanying drawings.

DETAILED DESCRIPTION OF THE INVENTION

Figure 1:
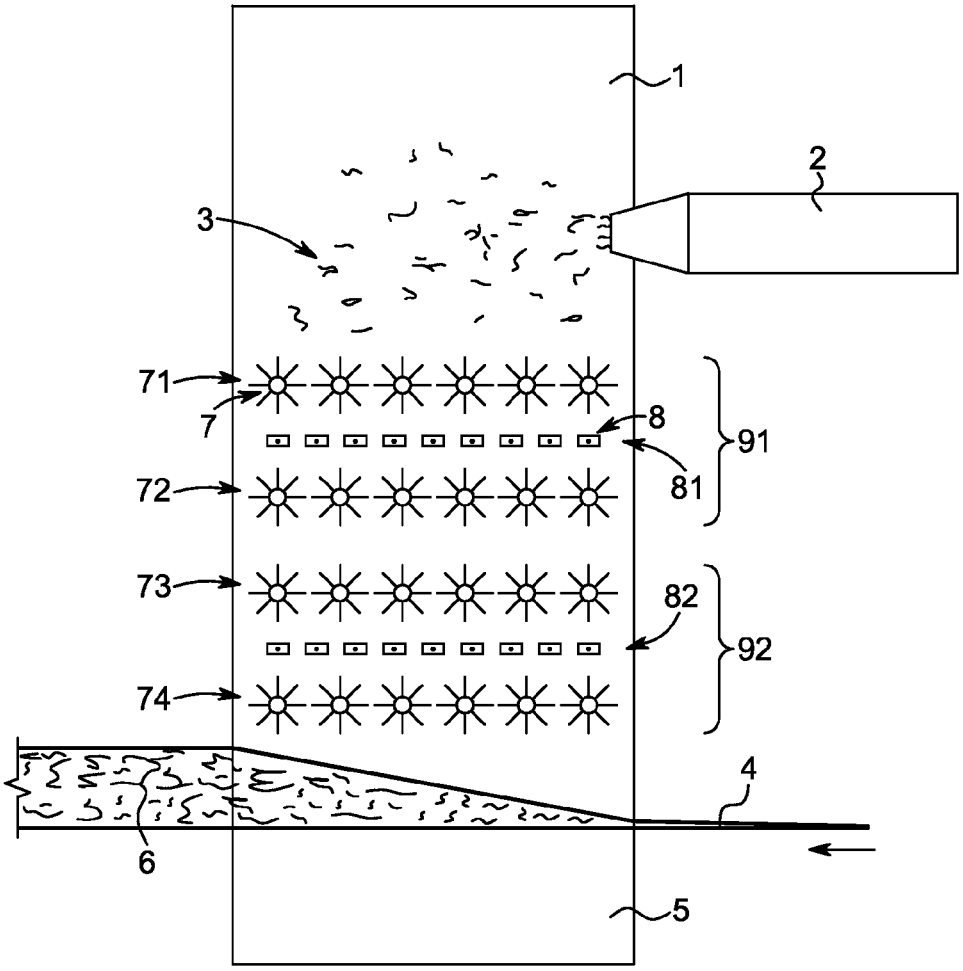
FIG. 1 a schematic side view of a forming box according to an embodiment of the invention.

In FIG. 1 a forming box according to a first embodiment of the invention is shown. The forming box comprises a housing 1 into which fibres 3 are supplied from an inlet 2. The forming box is positioned above a forming wire 4 onto which the fibres 3 are air laid due to a vacuum box 5 underneath the forming wire 4 to form a fibre mat 6 in a dry forming process. In FIG. 1, the forming box is shown in a cross-sectional view with the interior elements visible in the housing.

The fibre mat 6 may be made from or at least include natural fibres, such as cellulose fibres, animal hair, fibres from flax, hemp, jute, ramie, sisal, cotton, kapok, glass, stone, old newsprint, elephant grass, sphagnum, seaweed, palm fibres or the like. These fibres have a certain insulating capacity which may be useful in many applications. The fibreboard 6 may also be made from or at least include a portion of synthetic fibres, such as polyamide, polyester, polyacrylic, polypropylene, bicomponent or vermiculite fibres or the like as well as any kind of granular material.

Fibreboards with such synthetic fibres may be used for providing the fibre product with certain properties, e. g. absorbent products. Moreover, the fibres may be pretreated with a fire retardant or a fire retardant may be supplied directly in the fibre mixture which is blown into the forming box.

The fibres 3 are blown into the housing 1 of the forming box via the inlet 2. Inside the forming box a number of spike rollers 7 are provided in one or more rows, e. g. four rows of spike rollers 71, 72, 73, 74 as shown in FIG. 1. In the housing, two screens 81, 82 having a number of slats 8 arranged in rows, can be seen. These screens 81, 82 are arranged in between and adjacent to two rows of spike rollers, in two sections 91, 92. In the first section 91 the rows of spike rollers 71 are situated adjacent and at a higher level than the screen 81. On the opposite side of the screen 81 a row of spike rollers 72 is present at a lower level. The lower section 92 is similar to the upper section 91 but arranges at a different level in the housing 1.

The screens 81, 82 has slats 8 that are rotatable, in the present embodiment they have a rectangular cross section and are rotated continuously in order to condition the fibres 3 by way of turbulence generated from the rotation. The fibres 3 may be supplied into the housing 1 in lumps. The spike rollers 7 then disintegrate or shred the lumps of fibres 3 in order to ensure that the fibres are no larger than a desired size. In the upper section 91 the fibres pass the spike rollers 71 in the first row 71, subsequently the screen 81 and then the second row of spike rollers 72 as the fibres are sucked downwards in the housing 1. The fibres 3 then pass the lower section 92 in similar fashion as the upper section 91. It is not necessary to have two sections 91, 92 as shown in FIG. 1. However, it is preferred in order to ensure that all the fibre 3 lumps are shredded and distributed as desired, rather than just sucked towards the forming wire 5 which can result in an uncontrollable and uneven formation of mat on the forming wire 5.

The continuous rotation ensures that the fibres 3 adjacent to the screen 81 and 82 are stirred up and mixed, ensuring a uniform distribution of the fibres 3. Further, the generated turbulence has the advantage that it ensures that the slats 8 are kept relatively free of fibrous material. In other words, the slats are self-cleaning because there will only be a minor amount of build-up of fibre material before the turbulence will suspend it again. This is advantageous as it prolongs the time needed between cleaning of the inside of the forming box.

Figure 2:
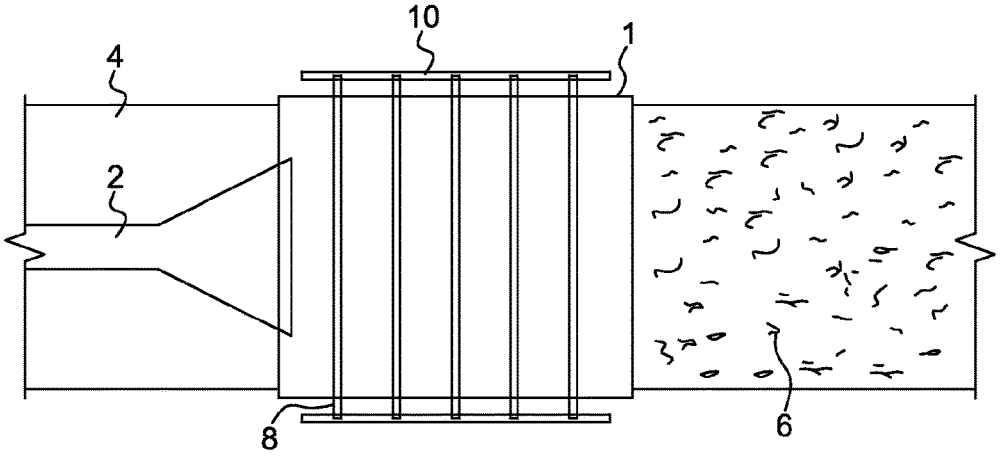
FIG. 2 a schematic top view of a forming box according to an embodiment of the invention.

FIG. 2 shows a top view of a forming box according to an embodiment of the invention. It has an inlet 2, which supplies fibres 3 (not shown in FIG. 2) to the housing 1. The forming wire 4 enters the housing 1 and exits the housing with the mat 6 formed on it. FIG. 2 only shows one screen with slats 8 in the housing 1, it is to be understood that the embodiment also has spike rollers 7 within the housing 1, as shown in FIG. 1. The slats 8 are arranged on a rack 10 and perpendicular to the moving direction of the forming wire 4. The slats 8 can have any angle, however, it is preferred that it is parallel or perpendicular to the moving direction of the forming wire 4 or any other angle. The rack 10 can be arranged so the slats 8 can be moved up, down or sideways so the distance between two slats 8 can be changed and/or the slats 8 in one screen can have different elevated positions than in another. The slats 8 are mounted on the rack 10 in a way so they can rotate. On the figures no rotation means are shown, however, it is known for the skilled person how to get a slat to rotate, this can be done by use of an motor, a step motor can be used if a specific angle for the slat is desired, however, other possibilities are available. The rack 10 is preferably placed outside the housing 1 so the bearing of the slats 8 are kept out of contact with the fibrous material which can harm the bearings.

The inlet 2 is located at a higher position than the screen of slats, further, there is row of spike rollers (not shown) at a higher position than the screen of slats 8. The vacuum box 5 ensures that there is an air flow from the inlet 2 to the vacuum box 5 so the fibrous material, which enters the housing through the inlet 2, gets sucked towards the forming wire 4 and there form a mat 6 of fibrous material. The fibrous material 3 is shredded by the spike rollers and pas the screen of slats where it is slowed down and mixed due to the turbulence generated by the screen. Hereby a relatively uniform distribution of the fibrous material in the volume below the screen is achieved.

If a uniform fibre mat is to be produced, it is desirable that; firstly, lumps of fibrous material that enter through the inlet are shredded, this is ensured by the spike rollers; secondly, that the shredded fibrous material containing no large lumps are distributed evenly within the housing 1 so it gets uniformly distributed on the forming wire 3. There may be use of a plurality of sections comprising spike rollers and a screen of slats in order to ensure that all the lumps of fibrous material has been fragmented and distributed evenly. It may be advantageous to direct some of the fibrous material to certain spaces within the housing, in order to compensate for the effects on the flow from the walls or other objects within the housing 1.

If a non-uniform fibre mats are to be produced, the forming wire may have a non-constant speed and/or the screen of slats can be used to direct the fibrous material towards a specific area of the forming wire 4.

Figure 3:
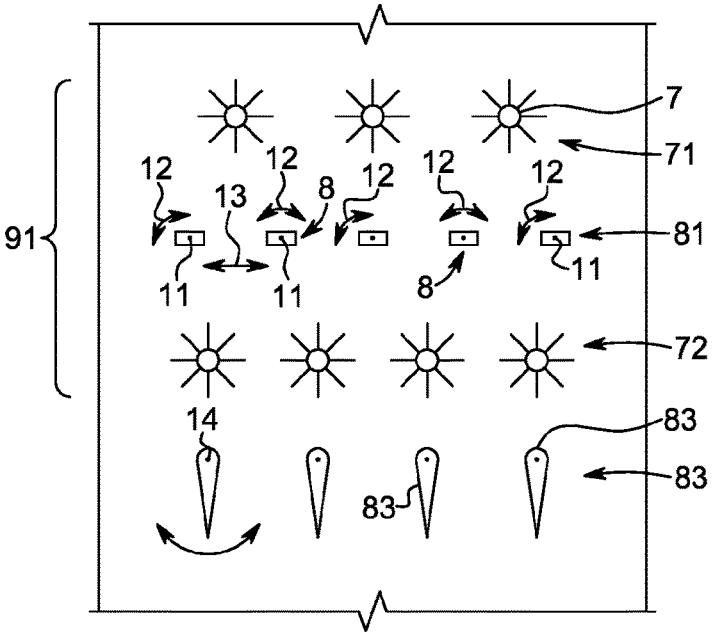
FIG. 3 a schematic side view of an arrangement of spike rollers and slats.

In FIG. 3 a schematic view of a different setup of spike rollers and slats is shown. It discloses a section similar to the sections 91 shown in FIG. 1 having a screen of slats 8 between two rows of spike rollers 71, 72 further, an additional screen of slats 83 is arranged under the section 91. The additional screen has slats 83 with a cross-section similar to a fin so that the fibrous material can be distributed by positioning them in a specific angle. The slats 8 in the screen 81 have a rectangular cross section and are pivotally mounted on an axle 11 so they can rotate as illustrated by the arrows 12. The slats can also be shifted horizontally as illustrated by the arrow 13. Thereby, a large degree of freedom in adjusting the screen 81 is obtained. The screen can be adjusted to perform optimally for any fibrous material. The slats 83 can be pivoted around the axle 14 and can thereby direct the suspended fibrous material towards the desired area of the forming wire.

Figure 4:
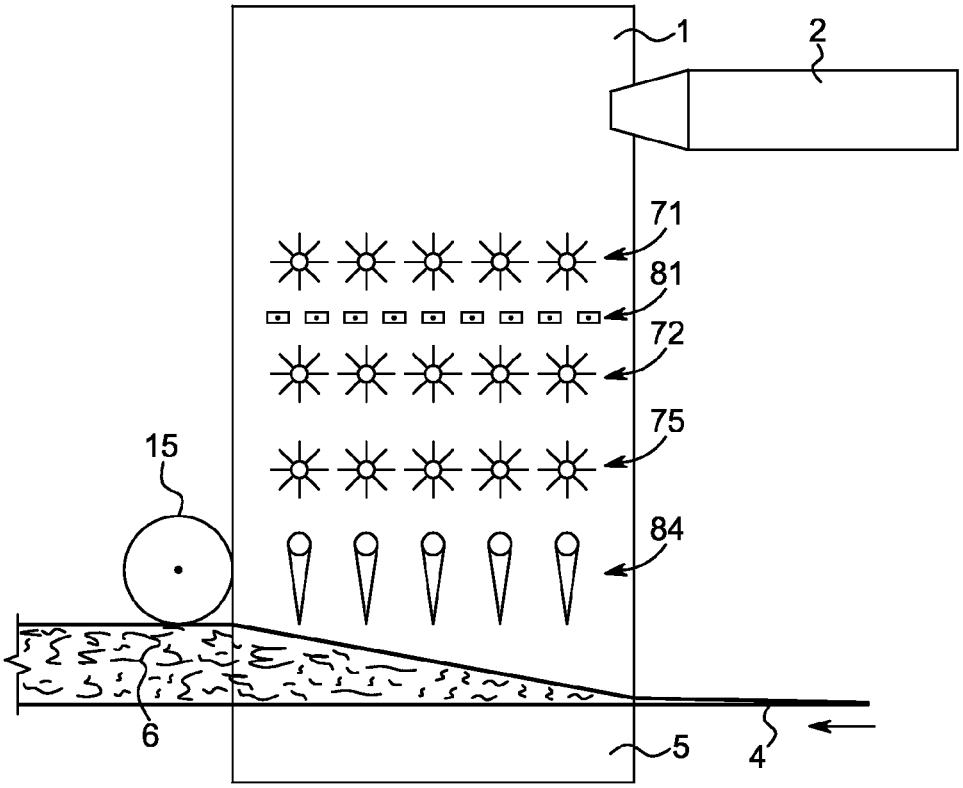
FIG. 4 a schematic side view of a forming box according to an embodiment of the invention.
Figure 5A:
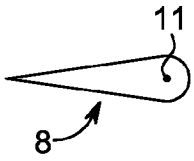
FIG. 5 a schematic cross-sectional view of different types of slats.
Figure 5B:
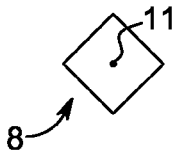
Figure 5C:
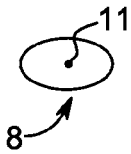
Figure 5D:
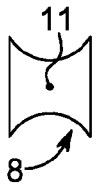
Figure 5E:
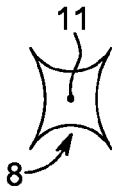
Figure 5F:
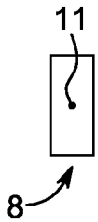
Figure 5G:
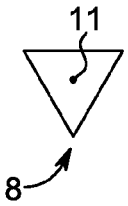

FIG. 4 discloses a cross sectional view of another embodiment of the invention. The forming box comprises a housing 1 with an inlet 2 and a vacuum box 5. The forming wire 4 enters the housing 1 and the fibrous material is sucked towards it, and a fibre mat is dry formed in it. The housing has a first row of spike rollers 71 and a second row of spike rollers in between the two, a screen of slats 81 is arranged. The screen 81 is arranged adjacent to the spike roller rows 71 and 72 and forms a section similar to the one described above. At a lower level in the housing 1 a third row of spike rollers 75 is arranged. Adjacent hereto there is an additional screen of slats 84. This screen of slats has the profile of a fin which is used to direct the flow of fibrous material.

The skilled person will realise that there are a plurality of possibilities for combining the number, position and/or revolution speed of spike rollers and number, position, rotational patterns and/or angular position of the slats.

The embodiment in FIG. 4 further has a roller adapted to press the fibre mat 6 hereby ensuring an even height of the fibre mat 6.

FIG. 5 discloses a cross sectional view of different slats 8. They are pivotally mounted on an axle 11. The Skilled person will acknowledge that the slats can be designed with the axle at a different place whereby the rotational pattern is changed. The slat on FIG. 5*a* has the form of a fin and is preferably used to direct airflow where the fibrous material is suspended. On FIGS. 5*b* and 5*f* a square and rectangular slat is shown, respectively they are preferably used to generate turbulence. The cross section in FIG. 5*c* is oval and in FIGS. 5*d* and 5*e* it is a square with two or four sides, respectively, has the form of a circular arc. The cross section can also be triangular.

In the above-described embodiments, the forming box is shown with one inlet 2. However, it is realised that multiple inlets may be provided, e. g. for supplying different types of fibres to the forming box. The spike rollers 7 and indeed the slats 8 will then assist in mixing the fibres inside the forming box.

In an embodiment, a granulate or another type of fibre may be supplied into the forming box above the fibre inlet 2 and mixed with the fibres adjacent the inlet opening inside the forming box. Such granulate is supplied separately to the forming box since it must be transported at a separate (higher) airflow velocity. This granulate may include vermiculite, rubber, plastic, glass fibre, rock wool, etc. The granulate may also include metal fibres, such as aluminium or brass, steel, etc.

The present invention is described above with reference to some preferred embodiments. However, it is realised that many variants and equivalents may be provided without departing from the scope of the invention, as defined in the accompanying claims.

The invention claimed is:

1. A forming box for use in dry-forming a mat of fibrous material, said forming box comprising:

a vacuum box;

a forming wire disposed above the vacuum box;

a housing disposed above the vacuum box, the housing having an inside and at least one fibre inlet for providing a fibre material to the inside of the housing, the housing having an open bottom for providing direct access of the fibre material onto the underlying forming wire;

a plurality of spike rollers disposed in at least one row in the housing between the fibre inlet and the open bottom of the housing; and at least one stationary screen disposed adjacent said spike rollers, said screen comprising a plurality of slats, wherein each slat is rotatable.

2. A forming box according to claim 1, wherein the slats extend substantially perpendicular and/or parallel to the direction of the fiber inlet.

3. A forming box according to claim 1, wherein all the slats are rotated in the same direction or different directions.

4. A forming box according to claim 1, wherein the slats are pivoted individually.

5. A forming box according to claim 1, further comprising a separate material inlet, a separate second type of fibre material being supplied through said separate material inlet, such that the second material supply is mixed with the fibres supplied through the fibre inlet.

6. A forming box for use in dry-forming a mat of fibrous material, said forming box comprising:

a vacuum box;

a forming wire disposed above the vacuum box;

a housing disposed above the vacuum box, the housing having an inside and at least one fibre inlet for providing a fibre material to the inside of the housing, the housing having an open bottom for providing direct access of the fibre material onto the underlying forming wire;

a plurality of spike rollers disposed in at least one row in the housing between the fibre inlet and the open bottom of the housing; and a screen disposed adjacent said spike rollers, said screen comprising a plurality of slats, wherein each slat is rotatable, wherein the slats have a non-symmetric cross-section.

7. A forming box for use in dry-forming a mat of fibrous material, said forming box comprising:

a vacuum box;

a forming wire disposed above the vacuum box;

a housing disposed above the vacuum box, the housing having an inside and at least one fibre inlet for providing a fibre material to the inside of the housing, the housing having an open bottom for providing direct access of the fibre material onto the underlying forming wire;

a plurality of spike rollers disposed in at least one row in the housing between the fibre inlet and the open bottom of the housing; and a screen disposed adjacent said spike rollers, said screen comprising a plurality of slats, wherein each slat is rotatable, wherein:

the plurality of spike rollers disposed in at least one row comprises at least two rows of spike rollers; and the screen comprises at least two screens adjacent the spike rollers, each screen comprising a plurality of slats, wherein each slat is rotatable.

8. A forming box for use in dry-forming a mat of fibrous material, said forming box comprising:

a vacuum box;

a forming wire disposed above the vacuum box;

a housing disposed above the vacuum box, the housing having an inside and at least one fibre inlet for providing a fibre material to the inside of the housing, the housing having an open bottom for providing direct access of the fibre material onto the underlying forming wire;

a plurality of spike rollers disposed in at least one row in the housing between the fibre inlet and the open bottom of the housing; and a screen disposed adjacent said spike rollers, said screen comprising a plurality of slats, wherein each slat is rotatable, wherein the slats are spaced apart by a predetermined mutual distance, said distance being adjustable.

9. A forming box for use in dry-forming a mat of fibrous material, said forming box comprising:

a vacuum box;

a forming wire disposed above the vacuum box;

a housing disposed above the vacuum box, the housing having an inside and at least one fibre inlet for providing a fibre material to the inside of the housing, the housing having an open bottom for providing direct access of the fibre material onto the underlying forming wire;

a plurality of spike rollers disposed in at least one row in the housing between the fibre inlet and the open bottom of the housing; and a screen disposed adjacent said spike rollers, said screen comprising a plurality of slats, wherein each slat is rotatable, wherein the rotation of the slats is controlled based on the properties of the mat exiting the forming box.

10. A forming box according to claim 9, further comprising a scanner, wherein the properties of the mat exiting the forming are determined by use of the scanner.

11. A forming box for use in dry-forming a mat of fibrous material, said forming box comprising:

a vacuum box;

a forming wire disposed above the vacuum box;

a housing disposed above the vacuum box, the housing having an inside and at least one fibre inlet for providing a fibre material to the inside of the housing, the housing having an open bottom for providing direct access of the fibre material onto the underlying forming wire;

a plurality of spike rollers disposed in at least one row in the housing between the fibre inlet and the open bottom of the housing; and a screen disposed adjacent said spike rollers, said screen comprising a plurality of slats, wherein each slat is rotatable, wherein the slats are adapted to neutralize a build-up of static electricity on the slats.

12. A method for the dry-forming of a mat of fibrous material, comprising the steps of:

blowing fibre material into a forming box having an open bottom positioned over a forming wire to form a mat of fibres on the forming wire, the forming box having a plurality of fibre separating spike rollers for breaking apart clumps of fibres;

providing at least one stationary screen of slats adjacent the spike rollers; and conditioning the fibres inside the housing by rotating one or more of the slats.

13. A method according to claim 12, wherein the conditioning of the fibres includes a step of stirring up the fibres inside the housing.

14. A method according to claim 12, wherein the conditioning involves directing the fibres towards the bottom of the forming box.

15. A method according to claim 12, further comprising:

providing a separate material inlet above the fibre inlet; and supplying a granulate material or a second type of fibre material through said separate material inlet, so this second material supply is mixed with the fibres supplied through the fibre inlet.

16. A method according to claim 15, wherein the supplying step comprises supplying the granulate material, the supplied granulate being selected from a group of materials consisting of vermiculite, rubber, plastic, glass fibre, and rock wool.

17. A method according to claim 15, wherein the supplying step comprises supplying a metallic granulate or metallic fibre selected from a group of materials consisting of aluminium, brass, and steel.

18. A method for the dry-forming of a mat of fibrous material, comprising the steps of:

blowing fibre material into a forming box having an open bottom positioned over a forming wire to form a mat of fibres on the forming wire, the forming box having a plurality of fibre separating spike rollers for breaking apart clumps of fibres;

providing a screen of slats adjacent the spike rollers; and conditioning the fibres inside the housing by rotating one or more of the slats, wherein the one of more of the slats are non-rotating.

19. A method according to claim 18, wherein the non-rotating slats are angled to direct the fibres towards the forming wire.

* * * * *